US005740827A

United States Patent [19]

Swarringim

[11] Patent Number: 5,740,827

[45] Date of Patent: Apr. 21, 1998

[54] TENT ANCHORING SYSTEM

[76] Inventor: Richard A Swarringim, 2124 S Main, Burlington, Iowa 52601

[21] Appl. No.: 832,901

[22] Filed: Apr. 3, 1997

[51] Int. Cl.[6] ..... E04H 15/62

[52] U.S. Cl. ..... 135/118; 248/530; 256/64

[58] Field of Search ..... 135/121, 124, 135/126, 120.3, 118, 119; 256/31, 35, 64; 248/530, 513, 508

[56] References Cited

U.S. PATENT DOCUMENTS

| | | | |
|---|---|---|---|
| 3,749,107 | 7/1973 | LaBerge | 135/118 X |
| 3,957,069 | 5/1976 | Denaro | 135/118 |
| 4,029,117 | 6/1977 | Rain | 135/118 X |
| 4,086,931 | 5/1978 | Hall | 135/118 X |
| 4,343,449 | 8/1982 | Osthus | 248/530 X |
| 4,480,023 | 10/1984 | McConnell et al. | 135/118 X |
| 4,913,428 | 4/1990 | Nauman | 135/118 X |

*Primary Examiner*—Christopher Kent
*Assistant Examiner*—Yvonne Horton-Richardson

[57] ABSTRACT

A new Tent Anchoring System for allowing users to set up a tent without the tent poles falling over. The inventive device includes an elongated bar which includes an elongated bar and at least three tent pole supporting posts mounted thereon.

8 Claims, 4 Drawing Sheets

FIG. 1
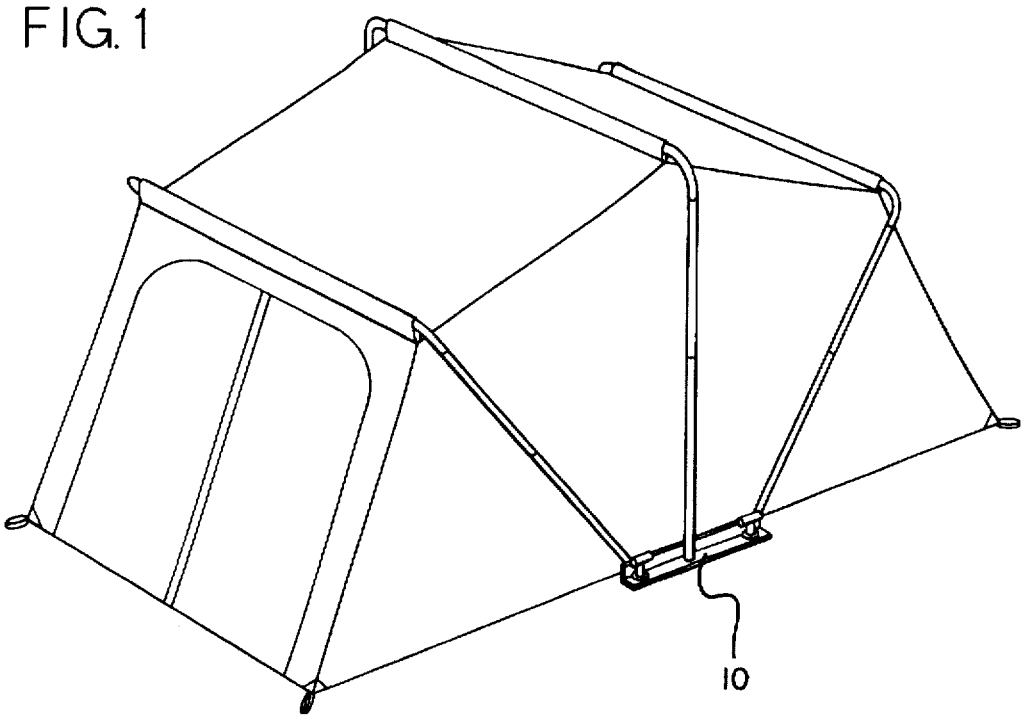
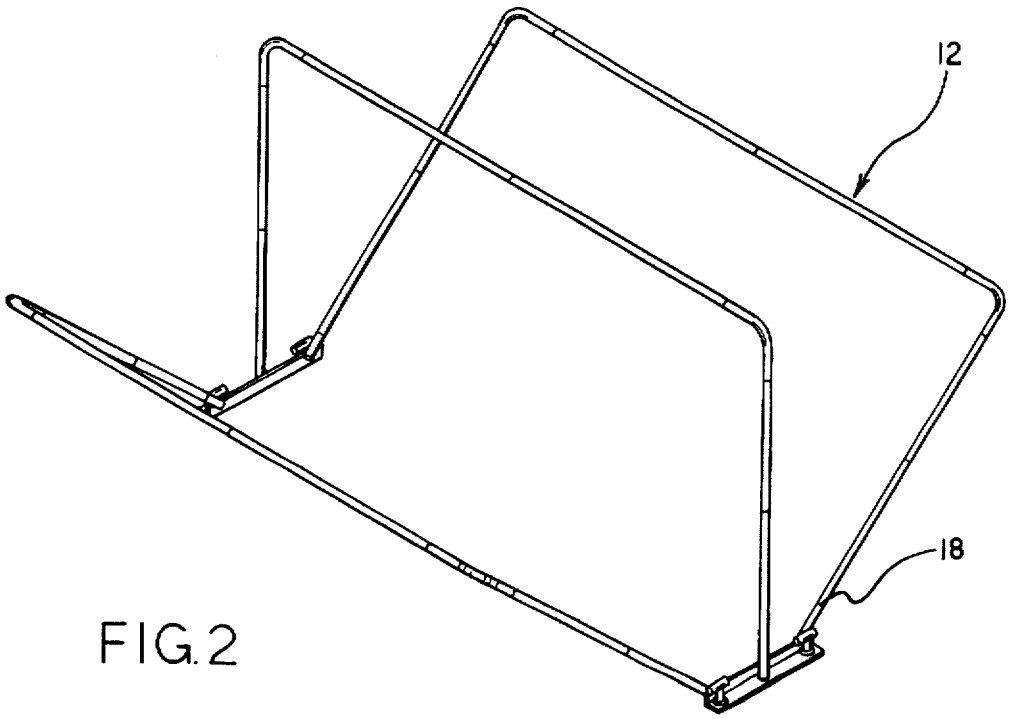
FIG. 2

FIG. 3
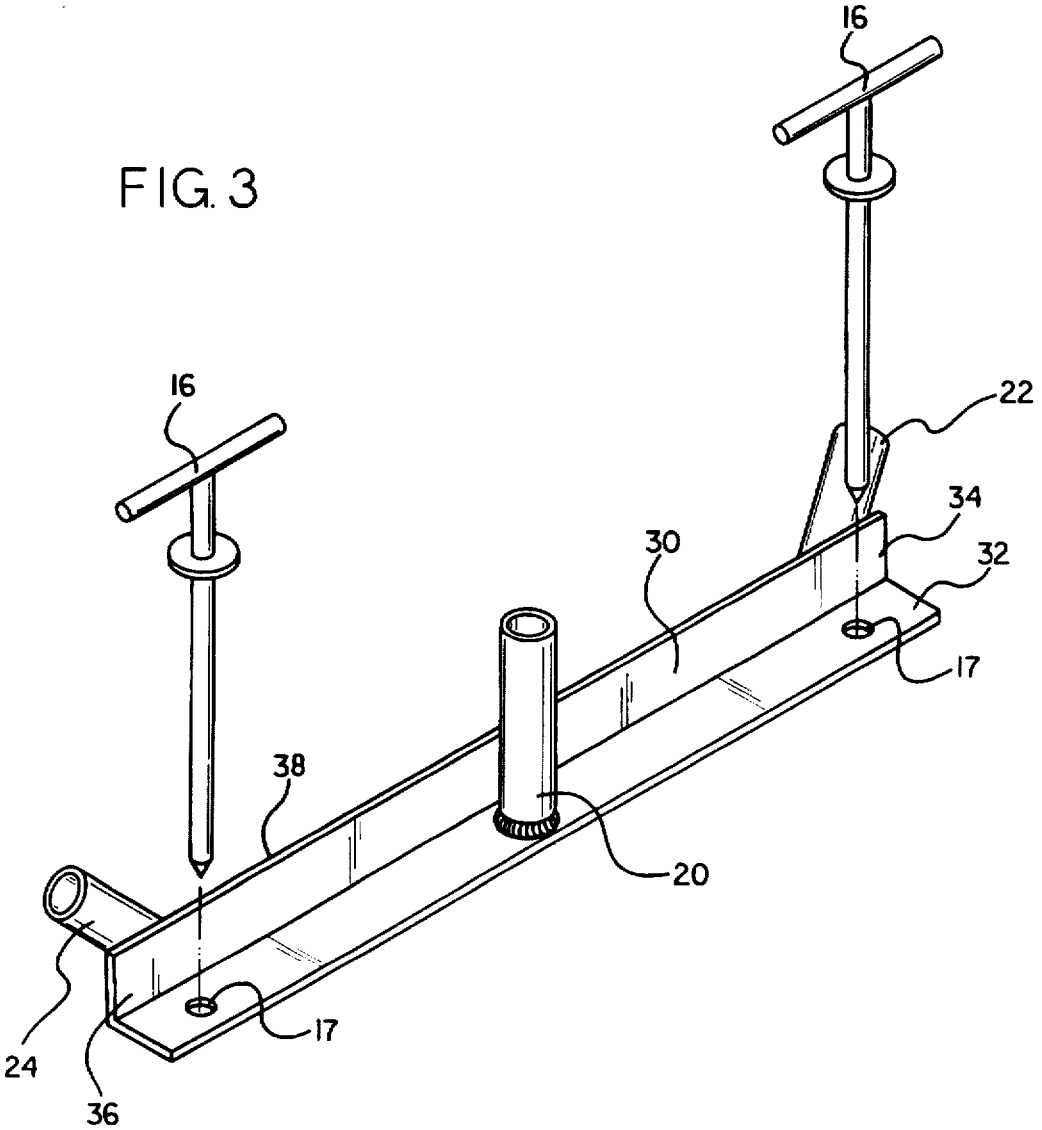
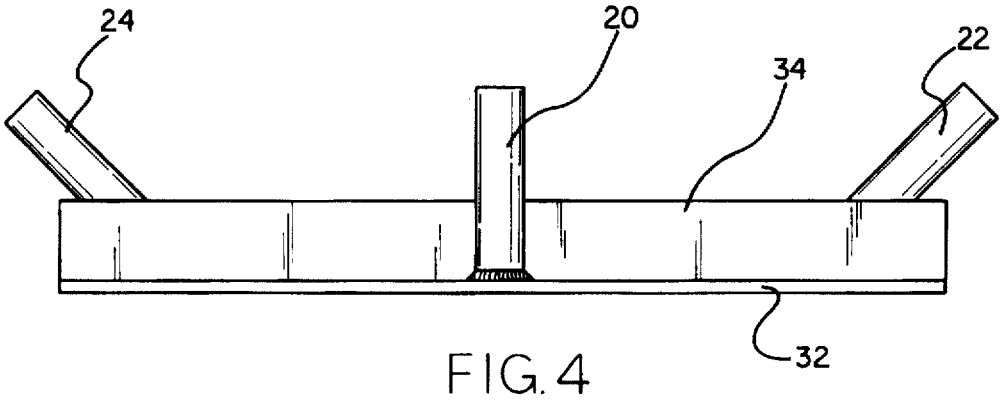
FIG. 4

FIG.5
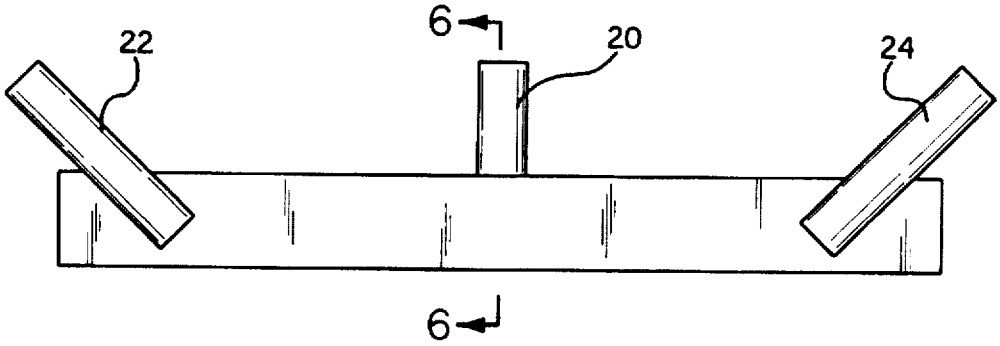
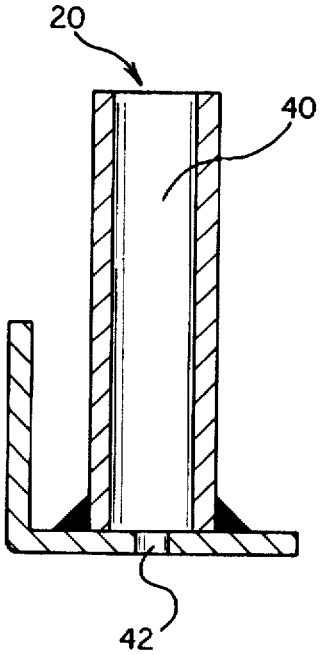
FIG.6

TENT ANCHORING SYSTEM

BACKGROUND OF THE INVENTION

1. Field of the Invention

The present invention relates to tent pole support systems and more particularly pertains to a new Tent Anchoring System for allowing users to set up a tent without the tent poles falling over.

2. Description of the Prior Art

The use of tent pole support systems is known in the prior art. More specifically, tent pole support systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art tent pole support systems include U.S. Pat. No. 4,782,846; U.S. Pat. No. 4,826,604; U.S. Pat. No. 5,281,067; U.S. Pat. No. 5,269,488; U.S. Pat. No. 4,905,718 and U.S. Pat. No. 4,432,382.

While these devices fulfill their respective, particular objectives and requirements, the aforementioned patents do not disclose a new Tent Anchoring System. The inventive device includes an elongated bar and at least three tent pole supporting posts mounted thereon.

In these respects, the Tent Anchoring System according to the present invention substantially departs from the conventional concepts and designs of the prior art, and in so doing provides an apparatus primarily developed for the purpose of allowing users to set up a tent without the tent poles falling over.

SUMMARY OF THE INVENTION

In view of the foregoing disadvantages inherent in the known types of tent pole support systems now present in the prior art, the present invention provides a new Tent Anchoring System construction wherein the same can be utilized for allowing users to set up a tent without the tent poles falling over.

The general purpose of the present invention, which will be described subsequently in greater detail, is to provide a new Tent Anchoring System apparatus and method which has many of the advantages of the tent pole support systems mentioned heretofore and many novel features that result in a new Tent Anchoring System which is not anticipated, rendered obvious, suggested, or even implied by any of the prior art tent pole support systems, either alone or in any combination thereof.

To attain this, the present invention generally includes an elongated bar and at least three tent pole supporting posts mounted thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Tent Anchoring System apparatus and method which has many of the advantages of the tent pole support systems mentioned heretofore and many novel features that result in a new Tent Anchoring System which is not anticipated, rendered obvious, suggested, or even implied by any of the prior art tent pole support systems, either alone or in any combination thereof.

It is another object of the present invention to provide a new Tent Anchoring System which may be easily and efficiently manufactured and marketed.

It is a further object of the present invention to provide a new Tent Anchoring System which is of a durable and reliable construction.

An even further object of the present invention is to provide a new Tent Anchoring System which is susceptible of a low cost of manufacture with regard to both materials and labor, and which accordingly is then susceptible of low prices of sale to the consuming public, thereby making such Tent Anchoring System economically available to the buying public.

Still yet another object of the present invention is to provide a new Tent Anchoring System which provides in the apparatuses and methods of the prior art some of the advantages thereof, while simultaneously overcoming some of the disadvantages normally associated therewith.

Still another object of the present invention is to provide a new Tent Anchoring System for allowing users to set up a tent without the tent poles falling over.

Yet another object of the present invention is to provide a new Tent Anchoring System which includes an elongated bar and at least three tent pole supporting posts mounted thereon.

Still yet another object of the present invention is to provide a new Tent Anchoring System that provides tent users an easier and and more effective way of anchoring a tent.

Even still another object of the present invention is to provide a new Tent Anchoring System that allows the base of tent poles to be inserted into the Anchoring System.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side perspective view of a new Tent Anchoring System in use with a tent.

FIG. 2 is a side view of the frame of a tent with the present invention installed.

FIG. 3 is an exploded illustration of the present invention.

FIG. 4 is a front elevation view of the invention.

FIG. 5 is a back view of the present invention.

FIG. 6 is a cross sectional view taken along line 6—6 of FIG. 5.

DESCRIPTION OF THE PREFERRED EMBODIMENT

Figure 7:
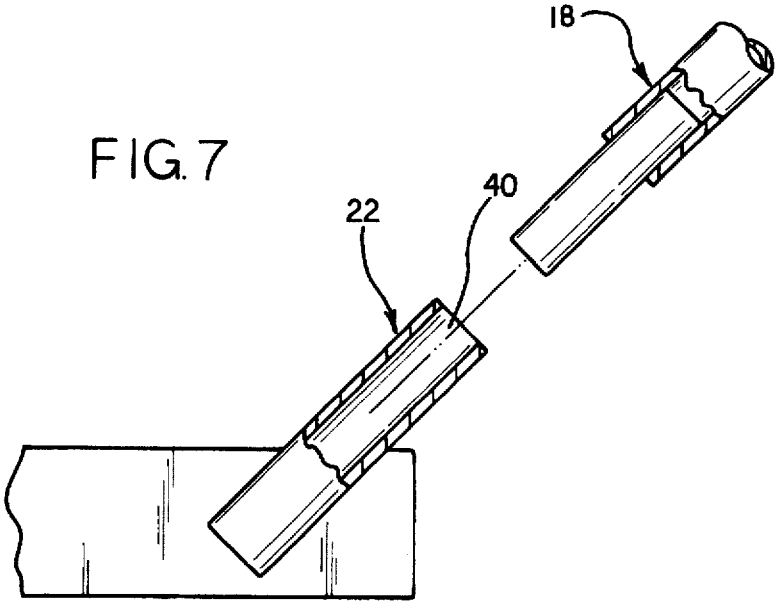
FIG. 7 is a view of one of the angular posts.
Figure 8:
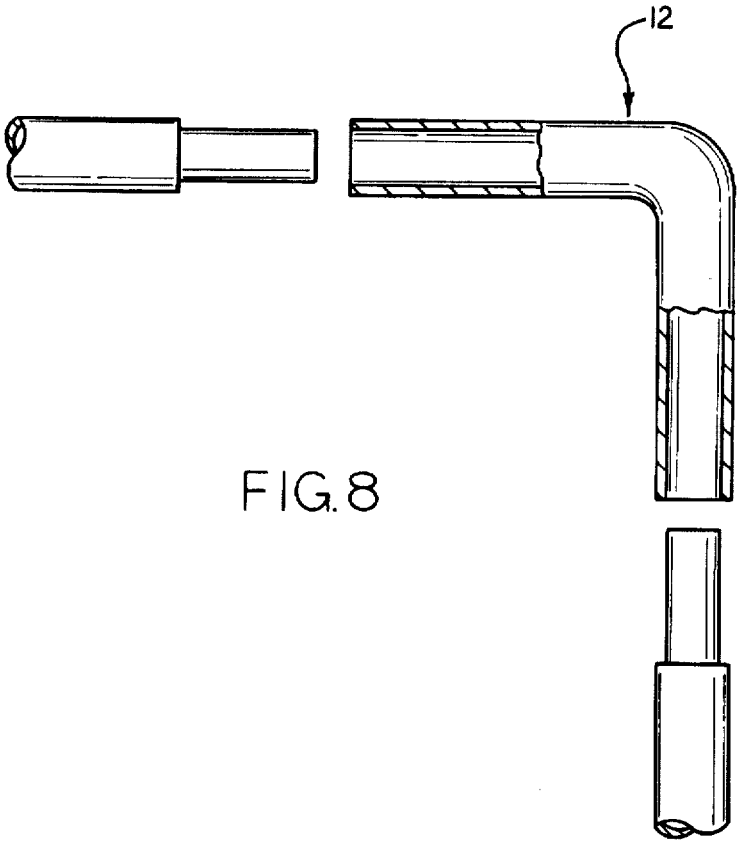
FIG. 8 is a side partial sectional view of a broken away portion of a tent support frame assembly.

With reference now to the drawings, and in particular to FIGS. 1 through 8 thereof, a new Tent Anchoring System embodying the principles and concepts of the present invention and generally designated by the reference numeral 10 will be described.

More specifically, it will be noted that the Tent Anchoring System 10 comprises an elongated bar which includes at least three posts for supporting the ends of tent support poles.

As best illustrated in FIGS. 1 through 8, it can be shown that the present invention teaches a novel nonobvious Tent Anchoring System which fills a need in the industry.

The present invention includes generally a Tent Anchoring System 10 which comprises an elongated bar 30. The elongated bar 30 preferably has a substantially L-shaped cross section with a horizontal section 32 and a vertical section 34. The vertical section 34 has an inside surface 36 adjacent to the horizontal section 32, and an outside surface 38 away from the horizontal section.

The elongated bar 30 is preferably formed of a strong, durable material that resists corrosion (e.g., from moisture from the weather and the soil). The preferred material of the present invention would be a metal such as aluminum (or a metal alloy), or even steel coated with plastic or a composite material. Illustratively, the elongated bar 30 measures about 24 inches in length about 4 inches high with a width of about 2 inches.

The horizontal section 32 includes at least two apertures 17 for receiving tent stakes 16 therethrough which are driven into the ground for anchoring the bar 30 in place. The horizontal section 32 is fixedly joined to the vertical section 34 to form approximately a 90 degree angle.

A first post 20 is fixedly connected to elongated bar 30 at a substantially central location of the elongated bar 30. Preferably the first post 20 is mounted to the horizontal section 32, and ideally the first post 20 forms a substantially vertical relationship with the horizontal section 32 (e.g., parallel to the vertical section 34). A second 22 and a third 24 post are each preferably fixedly connected to the elongated bar 30 at an outer longitudinal end of the bar 30. Most preferably, the second 22 and third 24 posts are each mounted to the vertical section 38, and ideally the second 22 and third 24 posts are mounted to the outside surface 38 of the vertical portion 34 to permit the tent stake apertures 17 to be located at longitudinally spaced locations on the horizontal section 32 without the posts 22, 24 interfering with the placement of the tent stakes through the apertures 17. The second 22 and third 24 posts most preferably form about a 45 degree angle with the horizontal section 32, although somewhat larger or smaller angles, such as between about 30 degrees and 60 degrees, may be employed. Posts 22 and 24 are substantially parallel to the vertical section 38 of the elongated bar 30 in the plane of the vertical section 38.

The first 20, second 22, and third 24 posts may comprise substantially hollow tubes that either receive into their interior 40 the ends of the tent poles or arc received into the interior of a hollow tent pole. Most preferably, the posts 20, 22, and 24 comprise solid bars that are received into the hollow ends of tent poles, which provides the benefit that the interiors of the posts do not collect dirt or moisture therein that may lead to corrosion.

Optionally, if a substantially hollow post is employed, a drainage aperture 42 may be formed in the horizontal section 32 below and in fluid communication with the interior 40 of the first post 20 to permit the drainage of any moisture accumulating in the post interior 40.

In use the present invention comprises, the steps of inserting the first, second and third posts 20, 22, 24 into a set of the support frame poles 18 of a tent. A pair of stakes 16 are driven into the ground through the pair of apertures 17 to thereby support a tent in position. The stakes 16 are preferably a "T" shaped metal rod which is formed to allow easy handling in hammering in the stakes and allows for easy removal of the stakes 16. It is necessary to use a pair of the present invention in setting up a tent. A pair of elongated bars 30 are used in pairs, with one bar 30 placed or located on each side of the tent.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Tent Anchoring System comprising: an elongated bar comprising a horizontal section and a vertical section, said horizontal section having at least two apertures therein for receiving tent stakes, a first post fixedly joined to said elongated bar and forming about a 90 degree angle with the horizontal section of said elongate bar, and a second and third post fixedly joined to said elongated bar at opposite end locations of said elongated bar.

2. The Tent Anchoring System of claim 1, wherein said first post is fixedly connected to the horizontal section of said elongated bar.

3. The Tent Anchoring System of claim 1, wherein the first post is substantially parallel to the vertical section of said elongated bar.

4. The Tent Anchoring System of claim 1, wherein the second and third posts are fixedly connected to the vertical section of said elongated bar.

5. The Tent Anchoring System of claim 1, wherein the second and third posts form an angle with the horizontal section of said elongated bar, and wherein said angle measures between about 30 and 60 degrees.

6. The Tent Anchoring System of claim 1, wherein the horizontal section comprises at least a pair of apertures for receiving tent stakes driven into the ground.

7. The Tent Anchoring System of claim 6, wherein the tent stakes include a head having a "T" shape.

8. The Tent Anchoring System of claim 1, wherein the elongated bar measures about 24 inches in length.

* * * * *